United States Patent [19]

Ohashi et al.

[11] Patent Number: 4,816,373

[45] Date of Patent: Mar. 28, 1989

[54] METHOD OF PRODUCING IMAGES

[75] Inventors: Minoru Ohashi; Shoichi Horii; Satoshi Kaneko, all of Nagaokakyo, Japan

[73] Assignee: Mitsubishi Paper Mills, Ltd., Tokyo, Japan

[21] Appl. No.: 10,006

[22] Filed: Feb. 2, 1987

[30] Foreign Application Priority Data

| | | | |
|---|---|---|---|
| Jan. 31, 1986 | [JP] | Japan | 61-20700 |
| Feb. 4, 1986 | [JP] | Japan | 61-22458 |
| Feb. 28, 1986 | [JP] | Japan | 61-43664 |

[51] Int. Cl.[4] ..... G03C 1/06

[52] U.S. Cl. ..... 430/264; 430/267; 430/268; 430/949

[58] Field of Search ..... 430/446, 448, 264, 267, 430/599, 600, 598, 949, 268

[56] References Cited

U.S. PATENT DOCUMENTS

| | | | |
|---|---|---|---|
| 4,243,739 | 1/1981 | Mifune et al. | 430/600 |
| 4,269,929 | 5/1981 | Nothnagle | 430/264 |
| 4,272,614 | 6/1981 | Mifune et al. | 430/600 |
| 4,294,919 | 10/1981 | Tsujino et al. | 430/589 |
| 4,323,643 | 4/1982 | Mifune et al. | 430/600 |
| 4,374,923 | 2/1983 | Hirano et al. | 430/598 |
| 4,686,167 | 8/1987 | Resnick et al. | 430/264 |

*Primary Examiner*—Won H. Louie

*Attorney, Agent, or Firm*—Cushman, Darby & Cushman

[57] ABSTRACT

Disclosed is a method for producing images which comprises imagewise exposing a silver halide photographic light-sensitive material and then developing the exposed light-sensitive material in the presence of a compound represented by the following general formula [I], [II] or [III]:

[I]

wherein Ar represents an aryl group, R represents a hydrogen atom, an alkyl group, an alkenyl group, an unsaturated hetero ring group or an aryl group and $R_1$ and $R_2$ each represent a hydrogen atom or a group represented by the general formula (i):

(i)

wherein $R_0$ represents an alkyl group, an alkenyl group, an aryl group, an alkoxy group or an aryloxy group and n is an integer of 1 or 2.

[II]

wherein Ar, $R_1$ and $R_2$ are as defined in the general formula [I] and $R_3$ and $R_4$ each represent a hydrogen atom, an alkyl group, an aryl group, an unsaturated hetero ring group or a substituted amino group and $R_3$ and $R_4$ may combine with each other to form a ring,

[III]

wherein Ar, $R_1$ and $R_2$ are as defined in the general formula [I] and $R_5$ represent a nitrogen-containing hetero ring residue.

6 Claims, No Drawings

METHOD OF PRODUCING IMAGES

BACKGROUND OF THE INVENTION

This invention relates to a method for development of a silver halide photographic light-sensitive material and a silver halide photographic light-sensitive material which provides negative images of markedly high contrast, negative images of high sensitivity and excellent dot image quality.

Addition of a hydrazine compound to silver halide photographic emulsions or developers has been known, for example, in U.S. Pat. No. 3,730,727 (developer comprising combination of ascorbic acid and hydrazine), U.S. Pat. No. 3,227,552 (use of hydrazine as an auxiliary developer for obtaining a direct positive color image), U.S. Pat. No. 3,386,831 (use of $\beta$-monophenylhydrazide of a fatty carboxylic acid as a stabilizer for silver halide sensitive materials), U.S. Pat. No. 2,419,975, Mees' "The Theory of Photographic Process", the third edition (1966), page 281, etc.

Especially, the above U.S. Pat. No, 2,419,975 discloses formation of high contrast negative images by addition of hydrazine compounds.

That is, this U.S. patent discloses that when a hydrazine compound is added to a silver chlorobromide emulsion and development is effected with a developer of high pH of 12.8, a very high contrast characteristic of more than 10 in $\gamma$ value can be obtained. However, a strongly alkaline developer having a pH of near 13 is easily oxidized with air and thus unstable and cannot be stored or used for a long time. On the other hand, the super high contrast photographic characteristic of more than 10 in $\gamma$ value is very useful for photographic reproduction of continuous tone images or line images by dot images useful for printing plate making regardless of whether they are negative images or positive images.

For this purpose, hitherto, there has been generally used a process of development with a hydroquinone developer of extremely low in actual concentration of sulfite ion (normally less than 0.1 mole/1) with use of a silver chlorobromide emulsion containing more than 50 mole %, preferably more than 75 mole % of silver chloride (so-called lith-type development).

However, according to the above process, since the concentration of sulfite ion in the developer is low, the developer is extremely unstable and cannot be stored for more than 3 days.

Furthermore, all of the above mentioned processes require the use of silver chlorobromide emulsion relatively high in silver chloride content and hence high sensitivity cannot be obtained.

Therefore, it has been strongly demanded to provide super high contrast photographic characteristic which is useful for reproduction of dot images and line images with use of high sensitive emulsion and stable developer.

U.S. Pat. Nos. 4,168,977, 4,224,401, 4,243,739, 4,269,929, 4,272,614, 4,323,643, etc. disclose silver halide photographic light-sensitive materials which provide extremely high contrast photographic characteristic using a stable developer, but it has been found that the acylhydrazine compounds used in these photographic materials have some problems.

That is, it is known that these hydrazines generate nitrogen gas during development, which gathers in the film to become bubbles and sometimes damage the photographic images.

Therefore, there has been desired such compound which can provide the photographic characteristic of markedly high contrast even with small addition amount for not only reducing generation of bubbles, but reducing the production cost. Furthermore, if development is continued with using these hydrazines, numerous circular fogs (pepper fogs) tend to occur in the unexposed area, which seriously damage the image quality.

In addition, the conventionally used hydrazines must be used in a large amount for sensitization with high contrast and when especially high sensitivity is required, desirably the hydrazines are used in combination with other sensitizing means (for example, use of strong chemical sensitization; increasing of grain size; addition of compounds which accelerate the sensitization such as those disclosed in U.S. Pat. Nos. 4,272,606 and 4,241,164, etc.). However, use of the sensitizing means sometimes causes increase in sensitivity and fog with time during storage.

Moreover, when development is carried out using the conventional hydrazines, so-called uneven development often occurs due to uneven agitation of developer. This uneven development is conspicuous when automatic developing equipment is used and when development is intensified in order to prevent the uneven development, the pepper fogging phenomenon occurs.

Thus, there has been demanded such compound as having no problems in time stability, no problems of uneven development and pepper fogging, being effective with addition of small amount and being able to be easily produced.

SUMMARY OF THE INVENTION

The first object of this invention is to provide a silver halide photographic light-sensitive material which can provide a photographic characteristic of very high contrast negative tone of more than 10 in gamma value using a stable developer.

The second object of this invention is to provide a negative type silver halide photographic light-sensitive material which contains hydrazines and which can provide a good image quality free from the problems such as uneven development and pepper fog.

The third object of this invention is to provide a negative type silver halide photographic light-sensitive material which contains hydrazines which provide a photographic characteristic of very high contrast negative tone with small addition amount without causing adverse effect on the photographic properties.

The fourth object of this invention is to provide a process for development of silver halide photographic light-sensitive materials in high contrast by adding hydrazines which can provide a photographic characteristic of good and rapid high contrast with processing stability (no uneven development and no pepper fog).

DESCRIPTION OF THE INVENTION

The above objects of this invention have been accomplished by developing a silver halide photographic material in the presence of a compound represented by the general formula [I], [II]or [III]shown below:

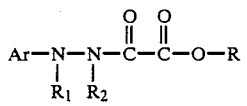

[I]

wherein Ar represents an aryl group, R represents a hydrogen atom, an alkyl group, an alkenyl group, an unsaturated hetero ring group or an aryl group and $R_1$ and $R_2$ each represent a hydrogen atom or a group represented by the general formula [i]:

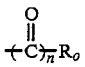

[i]

wherein $R_o$ represents an alkyl group, an alkenyl group, an aryl group, an alkoxy group or an aryloxy group and n is an integer of 1 or 2.

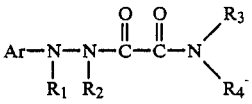

[II]

wherein Ar, $R_1$ and $R_2$ are as defined in the general formula [I] and $R_3$ and $R_4$ each represent a hydrogen atom, an alkyl group, an aryl group, an unsaturated hetero ring group or a substituted amino group and $R_3$ and $R_4$ may combine with each other to form a ring.

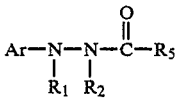

[III]

Wherein Ar, $R_1$ and $R_2$ are as defined in the general formula [I] and $R_5$ represents a nitrogen-containing hetero ring residue.

In the general formula [I], [II] and [III], the aryl group represented by Ar includes phenyl groups and naphthyl groups which may have substituent. As examples of the substituents, mention may be made of alkyl group, aryl group, halogen atom, alkoxy group, aryloxy group, alkenyl group, substituted amino group, acylamino group, sulfonamido group, alkylideneamino group, thiourea group, thioamido group, hetero ring group and combination of these groups.

In the general formula [I], the alkyl and alkenyl groups represented by R are preferably alkyl and alkenyl groups having 30 or less carbon atoms which may have substituent such as halogen atom, cyano group, carboxyl group, alkoxy group (including polyether group), aryloxy group, sulfo group, aryl group or substituted amino group.

The aryl group represented by R is phenyl or naphthyl group which may have substituent. As preferable substituents, mention may be made of alkyl group, aryl group, halogen atom, alkoxy group, aryloxy group, alkenyl group, substituted amino group, acylamino group, sulfonamido group, alkylideneamino group, hetero ring group or combination of these groups.

The unsaturated hetero ring group represented by R may link with a mono- or di-ring aryl group to form a hetero aryl group.

In the general formulas [I], [II]and [III], the alkyl and alenyl groups represented by $R_o$ in the general formula [i]are preferably alkyl and alkenyl groups having 30 or less carbon atoms which may have substituent such as halogen atom, cyano group, alkoxy group, aryloxy group, aryl group or substituted amino group.

The aryl group represented by $R_o$ is a phenyl or naphthyl group which may have substituent. Examples of the substituents are alkyl group, aryl group, halogen atom, alkoxy group, aryloxy group and combination of these groups.

The alkoxy group represented by $R_o$ is preferably an alkoxy group of 1–8 carbon atoms which may be substituted with halogen atom, aryl group, etc.

The aryloxy group represented by $R_o$ is preferably monocyclic and may be substituted with halogen atom, alkyl group, etc.

In the general formula [II], the alkyl group represented by $R_3$ and $R_4$ is preferably an alkyl group of 30 or less carbon atoms which may have substituent such as halogen atom, cyano group, carboxyl group, alkoxy group, aryloxy group, sulfo group, aryl group, substituted amino group, etc.

The aryl group represented by $R_3$ and $R_4$ is a phenyl or naphthyl group which may have substituent. As preferred examples of the substituents, mention may be made of alkyl group, aryl group, halogen atom, alkoxy group, aryloxy group, alkenyl group, substituted amino group, acylamino group, sulfonamido group, alkylidene amino group, hetero ring group and combination of these groups.

The unsaturated hetero ring group represented by $R_3$ and $R_4$ may link with a mono- or di-cyclic aryl group to form a hetero-aryl group.

The amino group represented by $R_3$ and $R_4$ is an amino group having substituent and preferred examples of the substituent are alkyl group, aryl group, alkenyl group, hetero ring group and combination of these groups.

In the general formula [III], the nitrogen-containing hetero ring residue represented by $R_5$ includes, for example, pyridyl group, pyrazinyl group, pyrimidinyl group, pyridazinyl group, quinolyl group, isoquinolyl group, phthalazinyl group, naphthyridinyl group, quinoxalinyl group, quinazolinyl group, cinnolinyl group and pteridinyl group. These groups may have substituent and examples of the substituents are alkyl group, aryl group, halogen atom substituted amino group, cyano group, acylamino group, carboxyl group, alkoxycarbonyl group, aryloxycarbonyl group and combination of these groups.

Ar, R, $R_3$, $R_4$ and $R_5$ in the general formulas [I], [II-]and [III]may have a ballast group incorporated therein which is commonly used in immobilized photographic additives such as coupler and the like. The ballast groups are groups of 8 or more carbon atoms which are relatively inert to photographic properties and can be selected from alkyl groups, alkoxy groups, phenyl group, phenoxy group, etc.

Examples of the compounds represented by the general formula [I]are shown below. However, this invention is not limited to the use of these compounds.

I-1.
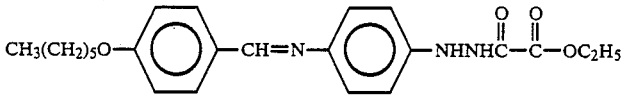
I-2.
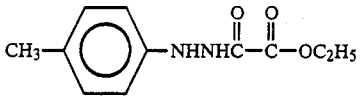
I-3.
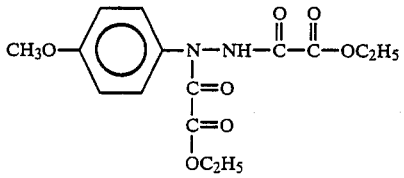
I-4.
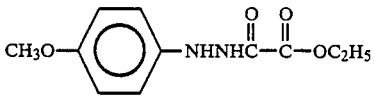
I-5.
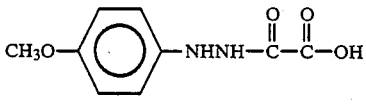
I-6.
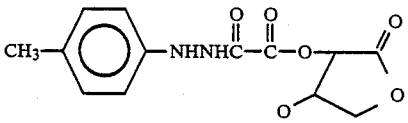
I-7.
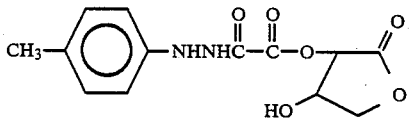
I-8.
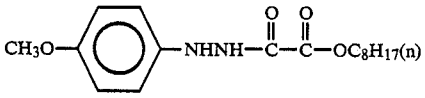
I-9.
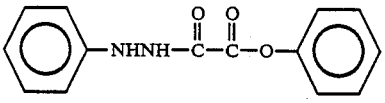
I-10.
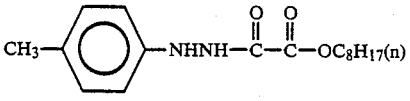
I-11.
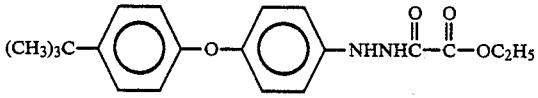
I-12.
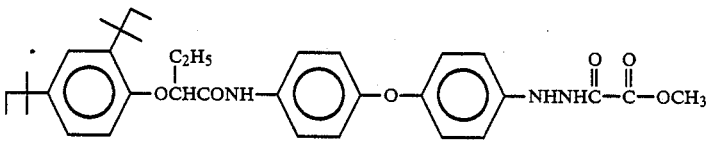

-continued
I-13.
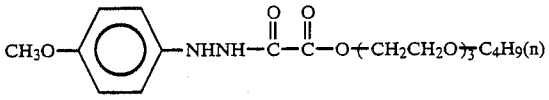
I-14.
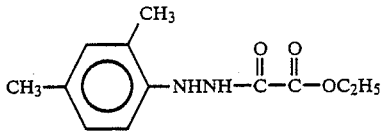
I-15
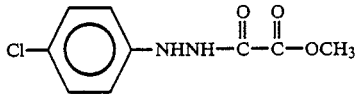
I-16.
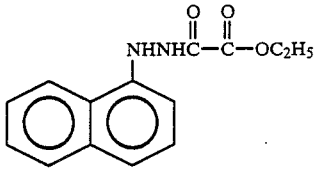
I-17.
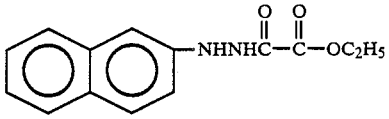
I-18.
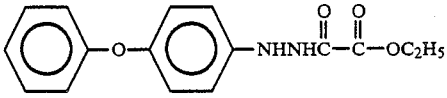
I-19.
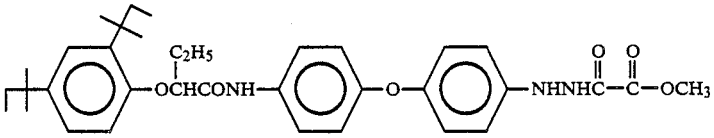
I-20.
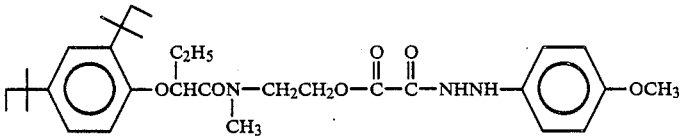
I-21.
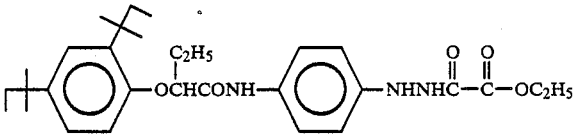
I-22.
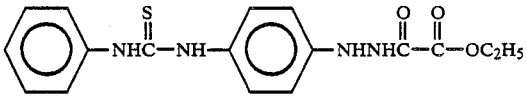
I-23.
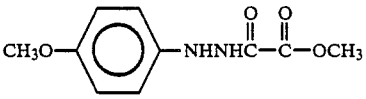

-continued
I-24.
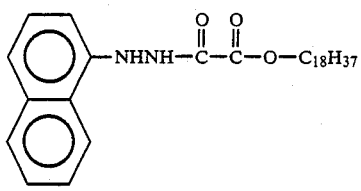
I-25.
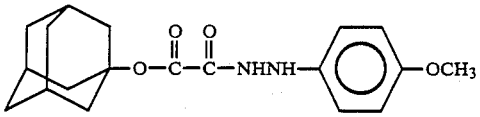
I-26.
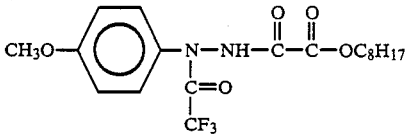
I-27.
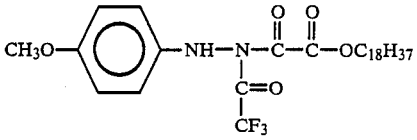
I-28.
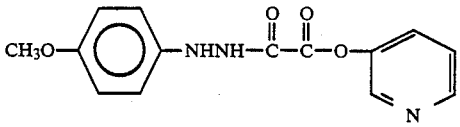
Examples of the compounds represented by the general formula [II]are shown below. However, this invention is not limited to use of these compounds.
II-1.
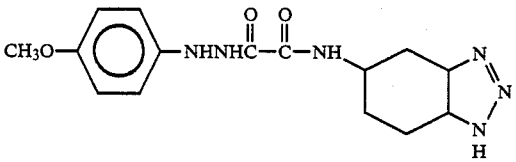
II-2.
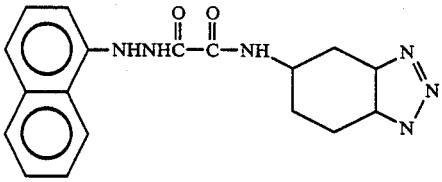
II-3.
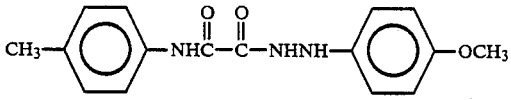
II-4.
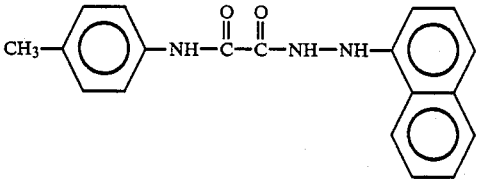

-continued
II-5.
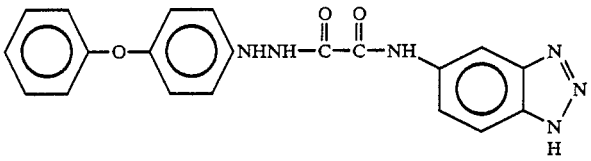
II-6.
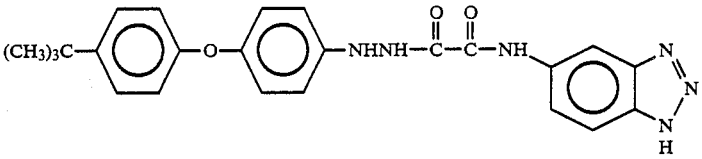
II-7.
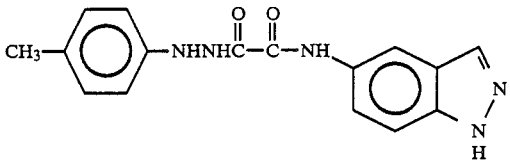
II-8.
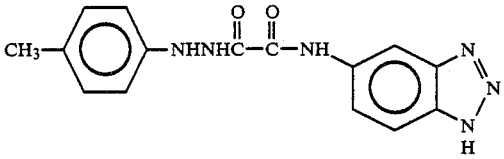
II-9.
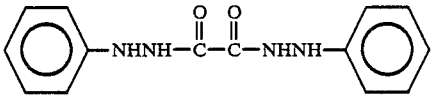
II-10.
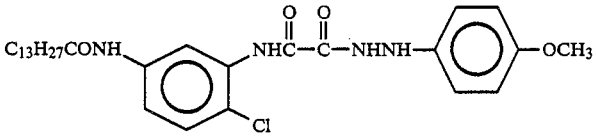
II-11.
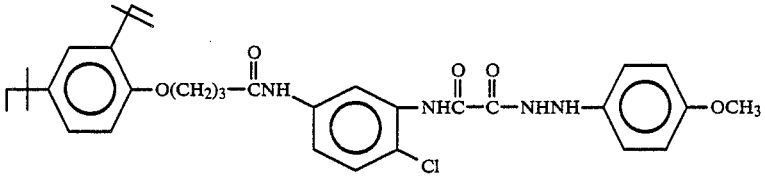
II-12.
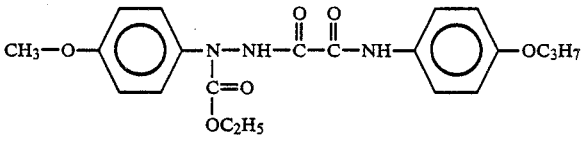
II-13.
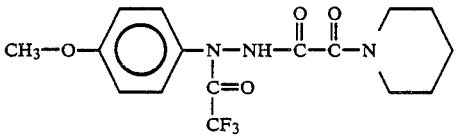
II-14.
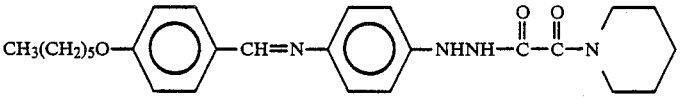

-continued
II-15.
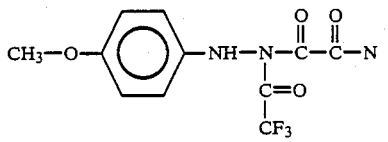
II-16.
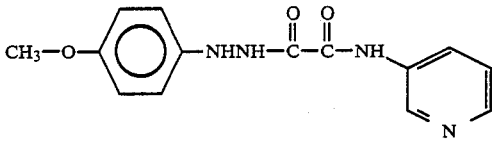
II-17.
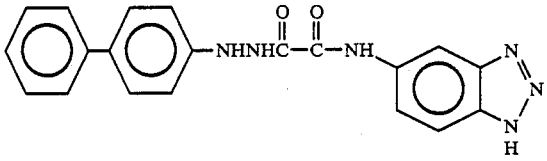
II-18.
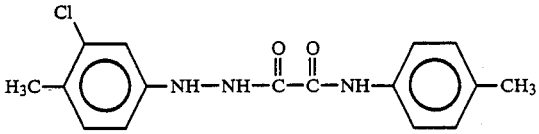
II-19.
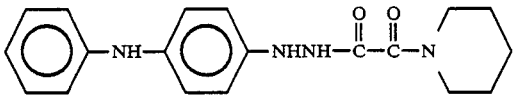
II-20.
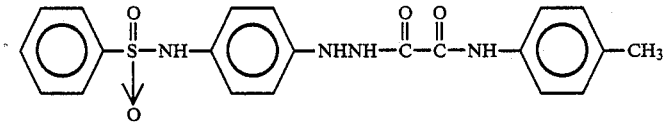
II-21.
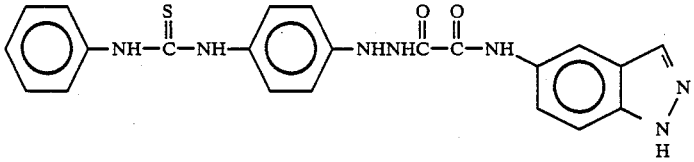
II-22.
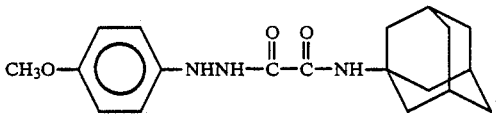
Examples of the compounds represented by the general formula [111]are shown below. However, this invention is not limited to use of these compounds.
III-1.
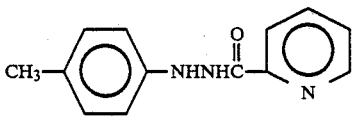
III-2.
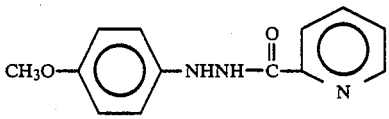

-continued
III-3.
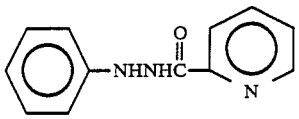
III-4.
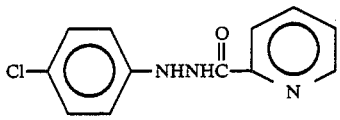
III-5.
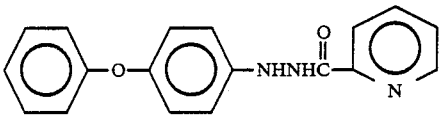
III-6.
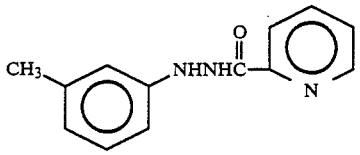
III-7.
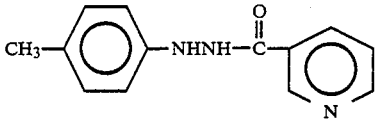
III-8.
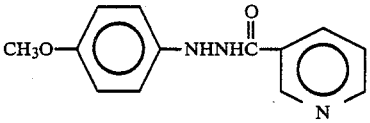
III-9.
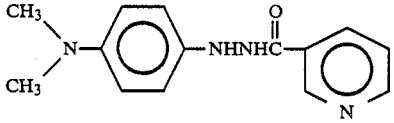
III-10.
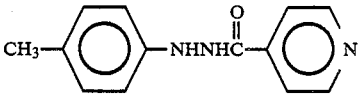
III-11.
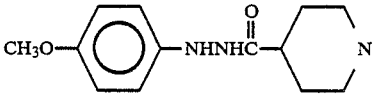
III-12.
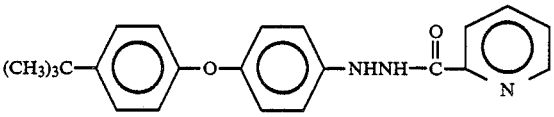
III-13.
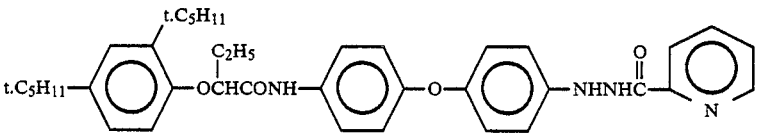

-continued
III-14.
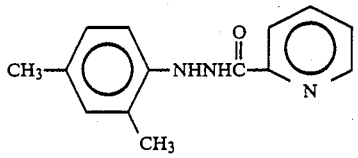
III-15.
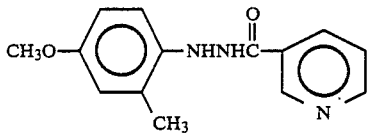
III-16.
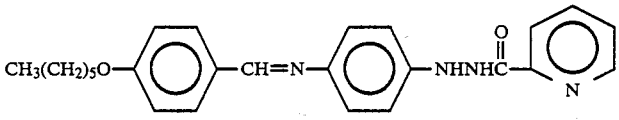
III-17.
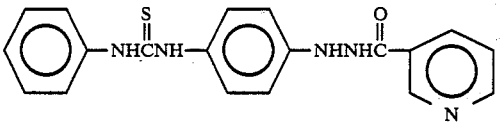
III-18.
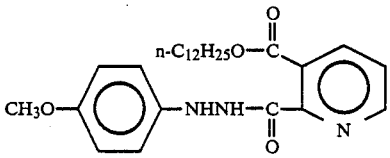
III-19.
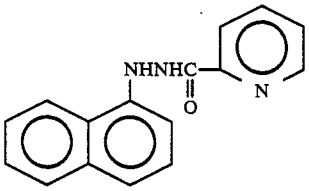
III-20.
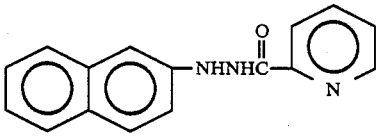
III-21.
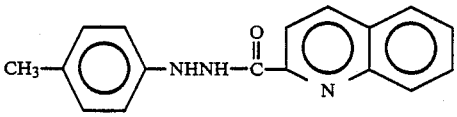
III-22.
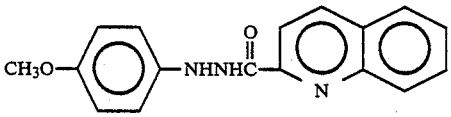
III-23.
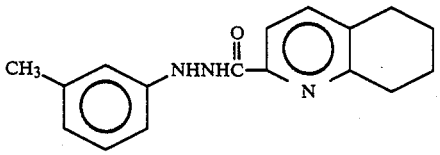

-continued

III-24.

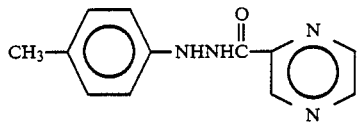

III-25.

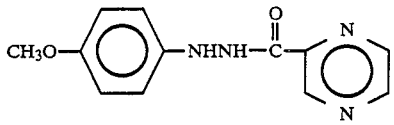

III-26.

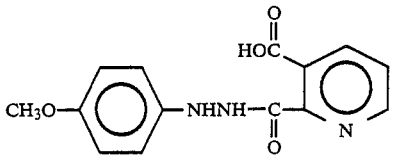

III-27.

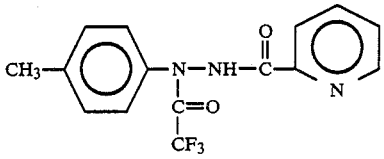

III-28.

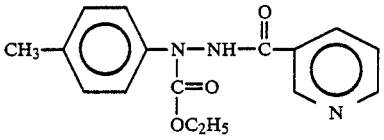

The compounds represented by the general formula [I]can be synthesized by various methods. They can be synthesized, for example, by reacting or merely heating a corresponding hydrazine compound ($Ar\text{-}NHNH_2$) and a compound represented by the following general formula (ii):

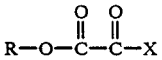

(wherein R is as defined in the general formula [I]and X represents a halogen atom, a phenoxy group, succinimido group or phthalimido group) in a suitable solvent such as dioxane, benzene or DMF in the presence of a base catalyst.

Other methods include utilization of ester exchange reaction as illustrated in the following synthesis examples and reaction of ascorbic acid with its corresponding diazonium salt.

Synthesis of the compounds represented by the general formula [I]is illustrated in the following synthesis examples.

SYNTHESIS EXAMPLE 1

(Compound I-1)

To 30.7 g of p-nitrophenylhydrazine was added 150 ml of diethyl oxalate and the mixture was heated and stirred for one hour over a water bath of about 80° C. After cooling, 50 ml of isopropyl ether was added to the reaction mixture to precipitate a crystal.

The resulting crude crystal was recrystallized with a ethyl acetate-benzene mixed solution to obtain 40.6 g of 1-ethoxalyl-2-(p-nitrophenyl)hydrazine. m.p. 187.0°-187.5° C.

Then, 25.3 g of the resulting 1-ethoxalyl-2-(p-nitrophenyl)hydrazine was dissolved in a mixed solvent of 300 ml ethanol and 200 ml dioxane. To the solution was added 20 g of 10% palladium-carbon to carry out catalytic reduction in the conventional manner to obtain 21.5 g of 1-ethoxalyl-2-(p-aminophenyl)hydrazine. m.p. 97°-99° C.

Then, 11.2 g of thus obtained 1-ethoxalyl-2-(p-aminophenyl)hydrazine was dissolved in 200 ml of ethanol, followed by adding 10.9 g of p-n-hexyloxybenzaldehyde and stirring overnight at room temperature.

After reaction, the precipitated crystal was filtered off and recrystallized with about 1 l of ethanol to obtain compound I-1.

Yield: 19.8 g m.p.:206.0°-207.0° C.

| (Analysis) | C % | H % | N % |
|---|---|---|---|
| Calcd. | 67.13 | 7.10 | 10.21 |
| Found | 67.10 | 7.08 | 10.35 |

SYNTHESIS EXAMPLE 2

(Compound I-4)

To 13 ml of diethyl oxalate and 10 ml of cyclohexane was added 1.4 ml of triethylamine and thereto was gradually added 1.75 g of p-methoxyphenylhydrazine hydrochloride with stirring at room temperature. After completion of the addition the reaction mixture was heated under reflux for one hour. After cooling, the precipitated crystal was filtered off, washed with water and dried. Thus obtained crude crystal was recrystallized from a ethylacetate-cyclohexane mixed solvent to obtain compound I-4.

Yield: 1.6 g, m.p.:130.0°-131.5° C.

| (Analysis) | C % | H % | N % |
|---|---|---|---|
| Calcd. | 55.46 | 5.92 | 11.76 |
| Found | 55.41 | 5.93 | 11.68 |

SYNTHESIS EXAMPLE 3

(Compound I-6)

A solution of 8.45 g of L-ascorbic acid in 85 ml of water and a solution of 4-methylbenzenediazonium sulfate in 120 ml of water were mixed and stirred for one hour at room temperature. After ice cooling the reaction mixture, the precipitated crystal was filtered off, washed with cold water and then dried to obtain a light yellow crystal.

Yield: 11.3 g. m.p.:180.5°-182.5° C.

| (Analysis) | C % | H % | N % |
|---|---|---|---|
| Calcd. | 53.06 | 4.80 | 9.52 |
| Found | 53.00 | 4.96 | 9.65 |

SYNTHESIS EXAMPLE 4

(Compound I-7)

A solution of 9.23 g of L-ascorbic acid in 90 ml of water and a solution of 4-methoxybenzenediazonium sulfate in 110 ml of water were mixed and stirred for one hour at room temperature. The reaction mixture was ice cooled and thereafter, the precipitate was filtered off, washed with a cold water and then dried to obtain a light yellow crystal, Compound I-7.

Yield: 10 g, m.p.:175.5°-177° C.

| (Analysis) | C % | H % | N % |
|---|---|---|---|
| Calcd. | 50.32 | 4.55 | 9.03 |
| Found | 50.30 | 4.36 | 9.16 |

SYNTHESIS EXAMPLE 5

(Compound I-8)

A solution of 1.55 g of Compound I-7 obtained in Synthesis Example 4 in 20 ml of dioxane and a solution of 0.13 g of metallic sodium in 5 ml of anhydrous n-octyl alcohol were mixed and heated and stirred for 4 hours over a water bath of 80°-90° C. After cooling, insoluble matters were filtered off and filtrate was concentrated under reduced pressure and the resulting residue was crystallized from cyclohexane-ethyl acetate mixed solvent to obtain Compound I-8.

Yield: 0.97 g, m.p.:89.5°-92.5° C.

| (Analysis) | C % | H % | N % |
|---|---|---|---|
| Calcd. | 63.33 | 8.13 | 8.69 |
| Found | 63.32 | 8.20 | 8.73 |

SYNTHESIS EXAMPLE 6

(Compound I-10)

30 ml of THF was added to 2.38 g of p-tolylhydrazine hydrochloride, followed by adding 2.43 ml of triethylamine. Then, to the mixture under cooling by a dry ice-methanol bath was gradually added dropwise a solution of 3.31 g of octylchloroglyoxylate in 15 ml of THF. After the addition, the mixture was stirred for 3 hours at the same temperature and the precipitate was filtered off and the filtrate was concentrated under reduced pressure and then subjected to silica gel chromatography to obtain Compound I-10.

Yield: 2.8 g. m.p.:114.0°-115.0° C.

| (Analysis) | C % | H % | N % |
|---|---|---|---|
| Calcd. | 66.64 | 8.55 | 9.14 |
| Found | 66.64 | 8.60 | 9.13 |

SYNTHESIS EXAMPLE 7

(Compound I-11)

To 2.92 g of 4-(4-tert-butylphenoxy)-phenylhydrazine hydrochloride and 14.61 g of diethyl oxalate were added 10 ml of cyclohexane and 1.39 ml of triethylamine and the mixture was heated under reflux for 3 hours. After completion of the reaction, the reaction mixture was introduced into water and extracted with ethyl acetate and dried with sodium sulfate, followed by concentration under reduced pressure. The resulting residue was recrystallized from a cyclohexane-ethyl acetate mixed solvent to obtain Compound I-11.

Yield:2.6 g m.p.:117.0°-118.0° C.

| (Analysis) | C % | H % | N % |
|---|---|---|---|
| Calcd. | 67.40 | 6.79 | 7.86 |
| Found | 67.31 | 6.80 | 7.93 |

The compounds represented by the general formula [II]can be synthesized by various methods. For example, they can be easily synthesized by reacting or merely heating a corresponding hydrazine compound (Ar-NHNH) and a compound represented by the general formula (iii) in a suitable solvent such as dioxane, benzene, DMF, etc. in the presence of a base catalyst.

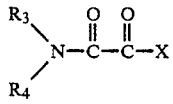

(iii)

(wherein $R_3$ and $R_4$ are as defined in the general formula [II]and X represents a halogen atom, a phenoxy group, succinimido group or phthalimido group).

The following are synthesis examples of the compounds represented by the general formula [II].

SYNTHESIS EXAMPLE 8

(Compound II-1)

To a mixture of 13.4 g of 5-aminobenzotriazole, 7.9 g of pyridine and 100 ml of dioxane with stirring at room temperature was added dropwise a solution of 18.5 g of phenyl-chloroglyoxalate in 70 ml of dioxane, followed by stirring for 4 hours at room temperature. Thereafter, a precipitated crystal was filtered off, thoroughly washed with water and then recrystallized from ethanol to obtain 19 g of 5-phenoxyoxaloylamino-benzotriazole. m.p.:300° C. or higher.

Then, to 8.0 g of the resulting 5-phenoxyoxaloylamino-benzotriazole and 5.2 g of 4-methoxyphenylhydrazine hydrochloride were added 100 ml of benzene and 3.0 g of triethylamine and the mixture was heated under reflux over a water bath. After completion of the reaction, the reaction mixture was concentrated under reduced pressure and the residue was washed with water and then recrystallized from methanol to obtain Compound II-1.

Yield: 6.0 g , m.p.:238.0°-239.5° C .

| (Analysis) | C % | H % | N % |
|---|---|---|---|
| Calcd. | 55.21 | 4.32 | 25.76 |
| Found | 55.19 | 5.34 | 25.68 |

SYNTHESIS EXAMPLE 9

(Compound II-6)

To 8.0 g of 5-phenoxyoxaloylamino-benzotriazole which was an intermediate in Synthesis Example 8 and 8.8 g of 4-(4-tert-butylphenoxy)phenylhydrazine hydrochloride were added 100 ml of dioxane and 3.0 g of triethylamine and the mixture was heated under reflux for 9 hours over a water bath. After completion of the reaction, the reaction mixture was concentrated under reduced pressure and the residue was washed with water and then recrystallized from ethanol to obtain Compound II-6.

Yield:9.3 g, m.p.:217.5°-219.5° C.

| (Analysis) | C % | H % | N % |
|---|---|---|---|
| Calcd. | 64.85 | 5.44 | 18.91 |
| Found | 64.86 | 5.50 | 18.98 |

SYNTHESIS EXAMPLE 10

(Compound II-11)

31.1 g of 2-chloro-5-[4-(2,4-di-tert-amylphenoxy)-butyroylamino)-aniline was dissolved in 200 ml of dioxane and thereto was added 7.8 g of triethylamine. To the solution under stirring with cooling by a cold water was gradually added 14.2 g of phenylchloroglyoxalate. After completion of the addition, stirring was carried out at room temperature for one hour and the precipitated salt was filtered off. The filtrate was concentrated under reduced pressure and used for the subsequent reaction.

11.85 g of the resulting 2-chloro-5-[4-(2,4 di-tert-amylphenoxy)butyroylamino]-phenoxaloylaniline was dissolved in 150 ml of benzene, followed by adding 3.66 g of 4-methoxyphenylhydrazine hydrochloride and 2.93 ml of triethylamine and heating under reflux for 2 hours over a water bath. After completion of the reaction, the reaction mixture was concentrated under reduced pressure and the resulting residue was washed with water and then recrystallized from a ethyl acetate-cyclohexane mixed solvent to obtain Compound II-11.

Yield:7.7 g, m.p.:135°-137° C.

| (Analysis) | C % | H % | N % |
|---|---|---|---|
| Calcd. | 65.97 | 7.12 | 8.79 |
| Found | 65.98 | 7.16 | 8.81 |

The compounds represented by the general formula [III]can be synthesized by various methods. They can be easily obtained, for example, by reacting a corresponding hydrazine compound (Ar-NHNH) with a carboxylic acid having nitrogen-containing hetero ring with dicyclohexylcarbodiimide in a suitable solvent such as acetonitrile, dioxane or the like or reacting the corresponding hydrazine compound with a carboxylic acid ester having nitrogen-containing hetero ring in a suitable solvent such as toluene, benzene, ethanol or the like. There may also be used another method comprising reacting a diazonium salt with α-pyridoin in acetone-water.

The following are synthesis examples of the compounds represented by the general formula [III].

SYNTHESIS EXAMPLE 11

(Compound III-1)

2.14 g (0.01 mol) of α-pyridoin was mixed with 85 ml of acetone and 10 ml of water. To the mixture with stirring at room temperature was added a solution of 2.2 g (0.01×1.02 mol) of 4-methylbenzenediazonium sulfate in 10 ml of water over a period of about 3 minutes, followed by stirring for 5 hours at the same temperature. Then, this was neutralized with aqueous sodium bicarbonate solution and treated with active carbon. The filtrate was concentrated under reduced pressure over a water bath and cooled with ice and the precipitated crystal was filtered off. This crystal was purified by column chromatography to obtain 1 g of the desired crystal. m.p. 152.5°-153.0° C.

SYNTHESIS EXAMPLE 12

(Compound III-7)

1.58 g (0.01 mol) of p-tolylhydrazine hydrochloride, 2.19 g (0.01×1.1 mol) of phenyl nicotinate and 1.06 g (0.01 ×1.05 mol) of triethylamine were mixed with 20 ml of toluene and heated under reflux for 10 hours, followed by adding water, extracting with ethyl acetate, washing with water and then dried over sodium sulfate. The extract was subjected to distillation under reduced pressure over a water bath and the residue was purified by column chromatography to obtain 1.36 g of the desired crystal. m.p. 124.5°-125.5° C.

SYNTHESIS EXAMPLE 13

(Compound III-22)

0.87 g (0.005 mol) of p-methoxyphenylhydrazine hydrochloride, 0.87 g (0.005 mol) of quinolin-2-carboxylic acid and 0.51 g (0.005 mol) of triethylamine were mixed with 20 ml of acetonitrile. To the mixture with stirring at room temperature was added a solution of 1.03 g (0.005 mol) of dicyclohexylcarbodiimide in 15 ml of acetonitrile over a period of about 3 minutes, followed by stirring for 4 hours at the same temperature. The precipitated crystal was filtered off and the filtrate was subjected to distillation under reduced pressure over a water bath to remove the distillate. The residue was purified by column chromatography to obtain 0.74 g of the desired crystal. m.p. 154.0°-155.0° C.

In the light-sensitive materials of this invention, the compounds represented by the general formulas [I], [II]and [III]are preferably contained in a surface latent image type silver halide emulsion layer, but may be contained in a hydrophilic colloid layer contiguous to the surface latent image type silver halide emulsion layer. Such layer may be any layer having any functions such as an undercoating layer, an intermediate layer, a filter layer, a protective layer, an antihalation layer or the like as long as it does not hinder the diffusion of the compounds to silver halide grains.

Content of the compound in the layer depends on properties of silver halide emulsion, chemical structure of the compound and conditions for development and may vary in a wide range, but practically preferred content is about $1\times10^{-6}-1\times10^{-2}$ mol for one mol of silver in the surface latent image type silver halide emulsion.

When the compounds used in this invention is contained in developer, content of the compound is preferably $10^{-4}10^{-1}$ mol/1, more preferably $5\times10^{-4}$-$5\times10^{-2}$ mol/1.

The silver halide used in the light-sensitive silver halide emulsion layer has no special limitation and there may be used silver chlorobromide, silver chloroiodobromide, silver iodobromide, silver bromide and the like. When silver iodobromide or silver chloroiodobromide is used, content of silver iodide is preferably 5 mol % or less.

There are also no special limitations in shape, crystal habit and size distribution of silver halide grains, but those of 0.7 μor less in grain size are preferred.

Sensitivity of the silver halide emulsion may be increased, without coarsening the grains, with gold compounds such as chloroaurate, gold trichloride, etc., salts of noble metals such as rhodium, iridium, etc., sulfur compounds which react with silver salts to produce silver sulfide and reducing materials such as stannous salts, amines, etc.

Furthermore, salts of noble metals such as rhodium, iridium, etc. or iron compounds such as ferricyanides may be present during physical ripening of silver halide grains of formation of nuclei.

Especially, addition of rhodium salts of complexes is preferred in that it further accelerates the effect of this invention of obtaining the super high contrast photographic characteristic in a short developing time.

The term "surface latent image type silver halide emulsion" in this specification means an emulsion comprising silver halide grains higher in surface sensitivity than interior sensitivity and this emulsion preferably has the difference between the surface sensitivity and the interior sensitivity as specified in U.S. Pat. No. 4,224,401.

The silver halide emulsion is preferably mcnodispersion and especially preferably has the mono-dispersibility as specified in the above U.S. Pat. No. 4,224,401.

The photographic emulsions used in this invention may be spectrally sensitized with methine dyes and the like.

The dyes used include cyanine dyes, merocyanine dyes, complex cyanine dyes, complex merocyanine dyes, holopolar cyanine dyes, hemicyanine dyes, styryl dyes, and hemioxonol dyes.

Expecially useful dyes are cyanine dyes, merocyanine dyes and complex merocyanine dyes.

These sensitizing dyes may be used alone or in combination. Use of the sensitizing dyes in combination is often employed for supersensitization.

Together with the sensitizing dyes, there may be contained in the emulsion those materials which per se have no spectral sensitizing action or absorb substantially no visible light, but which exhibit super-sensitizing action.

As binders or protective colloids used in emulsion layer or intermediate layer of the light-sensitive materials of this invention, gelatin is advantageously used, but other hydrophilic colloids may also be used. There may be used, for example, proteins such as gelatin derivatives, graft polymers of gelatin and other polymers, albumin, casein, etc.; cellulose derivatives such as hydroxyethyl cellulose, carboxymethyl cellulose, cellulose sulfate esters, etc.; sugar derivatives such as sodium alginate, starch derivatives, etc.; various synthetic hydrophilic polymer materials such as homo- or copolymers, e.g., polyvinyl alcohol, partial acetal of polyvinyl alcohol, poly-N-vinylpyrrolidone, polyacrylic acid, polymethacrylic acid, polyacrylamide, polyvinylimidazole, etc.

As gelatin, there may be used acid-treated gelatin and enzyme-treated gelatin disclosed in Bull. Soc. Sci. Phot. Japan, No. 16, P.30, (1966) as well as limetreated gelatin. Furthermore, hydrolyzates or enzyme decomposition products of gelatin may also be used. The photographic emulsions used in this invention may contain various compounds for preventing fog which may occur during preparation and storage of light-sensitive materials and during the photographic treatments or stabilization of photographic properties. That is, there may be added various compounds which have been used as antifoggants or stabilizers such as azoles, e.g., benzothiazolium salts, nitroimidazoles, nitrobenzimidazoles, chlorobenzimidazoles, mercaptothiazoles, mercaptobenzothiazoles, aminotriazoles, benzotriazoles, mercaptotetrazoles; mercaptopyrimidines, mercaptotriazines, thioketo compounds; azaindenes, etc. Of these compounds, especially preferred are benzotriazoles (e.g. 5-methylbenzotriazole) and nitroindazoles (e.g. 5-nitroindazole). These compounds may be contained in a processing solution.

Photographic emulsion layer and other hydrophilic colloid layers of the photographic materials of this invention may contain inorganic or organic hardeners. For example, there may be used alone or in combination chromium salts (chrome alum, etc.), aldehydes (formaldehyde, glyoxal, etc.), N-methylol compounds, dioxane derivatives (2,3-dihydroxydioxan, etc.), active vinyl compounds, active halogen compounds (2,4-dichloro-6-hydroxy-S-triazine, etc.), etc.

The photographic emulsion layer and other hydrophilic colloid layers may further contain various surface active agents for coating assistance, antistatic treatment, slip improvement, emulsification and dispersion, prevention of adhesion and improvement in photographic characteristics (e.g., acceleration of development, high contrast and sensitization). Examples of these agents are nonionic surface active agents such as saponin (steroid type), alkylene oxide derivatives (polyethylene glycol, polyethylene glycol alkyl ethers, etc.), glycidol devivatives (alkenyl succinic acid polyglyceride, etc.), fatty acid esters of polyhydric alcohols, alkyl esters of sugars, etc.; anionic surface active agents which contain acidic groups, e.g., carboxyl group, sulfo group, phospho goup, sulfate ester group, phosphate ester group, etc. such as alkyl carboxylates, alkyl sulfonates, alkyl sulfate esters, alkyl phosphate esters, etc.; and amphoteric surface active agents such as aminoacids, aminoalkylsulfonic acids, aminoalkyl sulfate or phosphate esters, etc.; and cationic surface active agents such as aliphatic or aromatic quaternary ammonium salts, hetero ring quaternary ammonium salts such as pyridinium, imidazolium, etc.

The photographic emulsion layer and other hydrophilic colloid layers of the light-sensitive materials of this invention may contain water insoluble or sparingly soluble synthetic polymer decomposition products for improving dimension stability. For example, there may be used polymers which contain, as monomer component, alkyl (metha)acrylate, alkoxyalkyl (meth)acrylate, glycidyl (meth)acrylate, (meth)acrylamide, vinyl acetate, acrylonitrile, olefins, styrenes, etc. alone or in combination or combinations of these compounds with acrylic acid, methacrylic acid, $\alpha,\beta$-unsaturated dicarboxylic acid, hydroxyalkyl(meth)acrylate, sulfoalkyl (meth)acrylates, styrenesulfonic acid, etc.

In order to obtain the super high contrast photographic characteristic using the silver halide light-sensitive materials of this invention, the conventional lith developers or highly alkaline developer of nearly pH 13 as described in U.S. Pat. No. 2,419,975 are not needed, but stable developers can be used. That is, for the silver halide photographic light-sensitive materials of this invention, there may be used developers which contain sufficient sulfite ion (especially, 0.15 mol/1 or more) as a preservative and further, negative images of super high contrast can be obtained with developers having a pH of 9.5 or higher, especially 10.5–12.3.

The developing agents usable in this invention have no special limitations and dihydroxybenzenes, 3-pyrazolidones, aminophenols, etc. may be used alone or in combination.

The developers may further contain pH buffers such as sulfites, carbonates, borates and phosphates of alkali metals and development controlling agents or antifoggants such as bromides, iodides, organic anti-foggants (especially preferred are nitroindazoles and benzotriazoles).

If necessary, the developers may further contain water softener, dissolving assistants, color toning agents, development accelerators, surface active agents, anti-foamers, hardeners, agents for prevention of film smudge due to silver (e.g., 2-mercaptobenzimidazole-sulfonic acid). Examples of these additives are mentioned in Research Disclosure No. 176, 17643, etc.

As fixing solutions, there may be used those of commonly used compositions.

As fixing agent, thiosulfates, thiocyanates, and furthermore organic sulfur compounds which are known to have fixing effect may be used.

The fixing solutions may contain water soluble aluminum salt as a hardener.

In this invention, there may be employed the method where the developing agent is contained in the light-sensitive material and treatment is carried out with an alkaline activator solution. (cf. Japanese Patent Unexamined Publication (Kokai) Nos. 129436/82, 129433/82, 129434/82, and 129435/82 and U.S. Pat. No. 4,323,643).

Treating temperature is normally 18°–50° C., but that of lower than 18° C. or higher than 50° C. may also be employed.

It is preferred to use automatic developing devices for photographic treatment. According to this invention, the photographic characteristic of super high contrast negative tone can be obtained even when the total treating time of from entering of the light-sensitive material into the automatic developing device until leaving the device is set at 60–120 seconds.

EXAMPLE 1

A silver iodobromide emulsion comprising cubic grains of 0.25 $\mu$in average grain size and containing 97% of AgBr and 3% of AgI was prepared by double-jet method. This emulsion was washed with water and redissolved by the conventional method and chemically sensitized with sodium thiosulfate.

This emulsion was divided into 17 portions and to each of them was added compound I-1, I-8, I-10, I-11, I-12, I-13, I-20 and comparative compound A in an amount indicated in Table 1, respectively. Each emulsion was coated on a polyester film at a coverage of 3.7 g/m$^2$ in terms of silver.

Thus produced film samples were exposed through a wedge and then developed with a developer of the following composition at 20° C. for 1–5 minutes.

| Developer | |
|---|---|
| Hydroquinone | 30 g |
| 4-Hydroxymethyl-4-methyl-1-phenyl-3-pyrazolidone | 0.3 g |
| Sodium sulfite | 75 g |
| EDTA 2 Na | 1.0 g |
| Tribasic potassium phosphate | 80 g |
| Potassium bromide | 2.0 g |
| NaOH | 13 g |
| 5-Methylbenzotriazole | 0.3 g |
| 1-Diethylamino-2,3-dihydroxypropane | 17 g |

Water was added to make up 1 l
PH was adjusted to 11.5 with potassium hydroxide.

Comparative compound A:

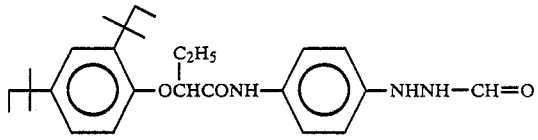

The results are shown in Table 1.

As is clear from Table 1, as compared with comparative compound A, the compounds of this invention nearly provided the high contrast photographic characteristic even with the development treatment of one minute at 20° C. and caused no increase of fog even after development for a long time.

It will be also recognized that the samples of this invention were high in stability against development because change in sensitivity with change in developing time was markedly smaller as compared with use of comparative compound A.

When unexposed portions of each sample after development was observed, it was found that clear pepper fog already occurred in the samples (Nos. 2 and 3) containing comparative compound A after development of 3 minutes while no pepper fog occurred in the samples (Nos. 4–17) containing the compounds of this invention.

TABLE 1

| Film No. | Compound | Addition amount[a] | Developing time (20° C.) 1 min Sensitivity[b] | γ[c] | Fog | 2 min. Sensitivity[b] | γ[c] | Fog | 3 min. Sensitivity[b] | γ[c] | Fog | 5 min. Sensitivity[b] | γ[c] | Fog |
|---|---|---|---|---|---|---|---|---|---|---|---|---|---|---|
| 1 | None | — | 8.1 | 4.0 | 0.00 | 9.1 | 4.0 | 0.00 | 10.0 | 4.1 | 0.00 | 10.2 | 4.0 | 0.02 |
| 2 | (A) | $2.0 \times 10^{-4}$ | 25.1 | 3.0 | " | 55.3 | 8.5 | " | 76.8 | >10 | 0.05 | 111.0 | >10 | 0.10 |
| 3 | " | $2.5 \times 10^{-3}$ | 30.2 | 3.5 | " | 75.9 | 10.0 | " | 89.1 | >10 | 0.07 | 138.0 | >10 | 0.15 |
| 4 | (I-1) | $2.0 \times 10^{-4}$ | 103.0 | >10 | " | 115.3 | >10 | " | 120.0 | >10 | 0.00 | 125.0 | >10 | 0.01 |
| 5 | " | $2.5 \times 10^{-3}$ | 110.0 | >10 | " | 120.1 | >10 | " | 126.0 | >10 | " | 130.0 | >10 | 0.02 |
| 6 | (I-8) | $2.0 \times 10^{-4}$ | 81.3 | 9.0 | " | 93.3 | >10 | " | 100.0 | >10 | " | 104.7 | >10 | 0.00 |
| 7 | " | $2.5 \times 10^{-3}$ | 95.5 | >10 | " | 106.0 | >10 | " | 118.0 | >10 | " | 121.0 | >10 | " |
| 8 | (I-10) | $2.0 \times 10^{-4}$ | 75.0 | 8.5 | " | 90.5 | >10 | " | 98.0 | >10 | " | 101.0 | >10 | " |
| 9 | " | $2.5 \times 10^{-3}$ | 80.5 | 9.0 | " | 92.6 | >10 | " | 102.0 | >10 | " | 108.0 | >10 | " |
| 10 | (I-11) | $2.0 \times 10^{-4}$ | 98.0 | >10 | " | 110.0 | >10 | " | 121.0 | >10 | " | 123.0 | >10 | " |
| 11 | " | $2.5 \times 10^{-3}$ | 100.3 | >10 | " | 115.0 | >10 | " | 123.8 | >10 | " | 128.3 | >10 | " |
| 12 | (I-12) | $2.0 \times 10^{-4}$ | 65.3 | 6.5 | " | 83.1 | >10 | " | 90.0 | >10 | " | 100.0 | >10 | " |
| 13 | " | $2.5 \times 10^{-3}$ | 75.0 | 9.0 | " | 91.6 | >10 | " | 98.5 | >10 | " | 109.0 | >10 | " |
| 14 | (I-13) | $2.0 \times 10^{-4}$ | 80.5 | 9.5 | " | 92.1 | >10 | " | 98.9 | >10 | " | 103.1 | >10 | " |
| 15 | " | $2.5 \times 10^{-3}$ | 85.9 | >10 | " | 98.0 | >10 | " | 111.3 | >10 | " | 120.0 | >10 | " |
| 16 | (I-20) | $2.0 \times 10^{-4}$ | 79.3 | 6.8 | " | 90.3 | >10 | " | 95.6 | >10 | " | 99.3 | >10 | " |
| 17 | " | $2.5 \times 10^{-3}$ | 84.5 | >10 | " | 97.5 | >10 | " | 110.3 | >10 | " | 118.0 | >10 | " |

[a]Addition amount is expressed by mol per one mol of silver.
[b]Exposure required for providing a density of 1.0 is expressed as relative sensitivity. (Sensitivity when the sample of Film No. 1 is subjected to development treatment for 3 minutes is taken as 10.0.)
[c]Average gradient between the density of 0.5 and 2.0.
These [a], [b] and [c] are applied to Table 4, 7 and 8.

EXAMPLE 2

A part of each film sample obtained in Example 1 was warmed at 40° C. for 30 days and thereafter, subjected to exposure and development (20° C., 30 min.) and sensitivity and degree of fog were compared with those of samples just after coating. The results are shown in Table 2.

TABLE 2

| Film No. | Compound | Just after coating Sensitivity | Fog | After warming at 40° C. for 30 days Sensitivity | Fog |
|---|---|---|---|---|---|
| 1 | None | 10.0 | 0.00 | 10.5 | 0.02 |
| 2 | (A) | 76.8 | 0.05 | 80.5 | 0.10 |
| 3 | " | 89.1 | 0.07 | 92.3 | 0.13 |
| 4 | (I-1) | 120.0 | 0.00 | 120.5 | 0.01 |
| 5 | " | 126.0 | " | 127.0 | 0.00 |
| 6 | (I-8) | 100.0 | " | 100.8 | " |
| 7 | " | 118.0 | " | 119.0 | 0.01 |
| 8 | (I-10) | 98.0 | " | 98.8 | " |
| 9 | – | 102.0 | " | 102.3 | " |
| 10 | (I-11) | 121.0 | " | 121.0 | " |
| 11 | " | 123.8 | " | 124.5 | 0.00 |
| 12 | (I-12) | 90.0 | " | 91.0 | " |
| 13 | " | 98.5 | " | 98.3 | 0.01 |
| 14 | (I-13) | 98.9 | " | 99.2 | 0.00 |
| 15 | " | 111.3 | " | 111.0 | " |
| 16 | (I-20) | 95.6 | " | 96.0 | 0.01 |
| 17 | " | 110.3 | " | 111.0 | 0.00 |

As is clear from Table 2, the compounds according to this invention caused very little change in sensitivity and increase in fog with time during storage.

EXAMPLE 3

Another portion of each of the film samples obtained in Example 1 was subjected to test on dot quality.

That is, each of them was subjected to exposure through an exposure wedge for sensitometry using a grey contact screen of 150 lines and then was developed with the same developer as used in Example 1 at 38° C. for 30 seconds. Dot quality of these samples was examined. The results are shown in Table 3.

The dot quality was visually evaluated and expressed by the following five grades. Namely, (5) means the best quality and (1) means the worst quality. The products of grades (5) and (4) are practically usable as a half tone plate for printing plate making, those of grade (3) are inferior, but are barely of practical use and those of grades (2) and (1) are practically not useable.

As is clear from Table 3, the compounds of this invention provided good dot quality.

TABLE 3

| Film No. | Compound | Dot quality |
|---|---|---|
| 1 | None | 1 |
| 2 | (A) | 3 |
| 3 | " | 3 |
| 4 | (I-1) | 4 |
| 5 | " | 5 |
| 6 | (I-8) | 5 |
| 7 | " | 5 |
| 8 | (I-10) | 5 |
| 9 | " | 5 |
| 10 | (I-11) | 5 |
| 11 | " | 5 |
| 12 | (I-12) | 4 |
| 13 | " | 5 |
| 14 | (I-13) | 4 |
| 15 | " | 5 |
| 16 | (I-20) | 5 |
| 17 | " | 5 |

EXAMPLE 4

Eleven film samples were made in the same manner as in Example 1 except that compounds II-1, II-6, II-10, and II-11 were used in the amounts as indicated in Table 4 in place of the compounds of the general formula [I]. These film samples were subjected to wedge exposure in the same manner as in Example 1 and then was developed in the same manner as in Example 1. The results are shown in Table 4.

As is clear from Table 4, as compared with comparative compound A, the compounds of this invention nearly provided the high contrast photographic characteristic even with the development of one minute at 20° C. and caused no increase of fog even after development for a long time.

It will be also recognized that the samples of this invention were high in stability against development because change in sensitivity with change in developing time was markedly smaller as compared with use of comparative compound A.

When unexposed portions of each sample after development was observed, it was found that clear pepper fog already occurred in the samples (Nos. 2 and 3) containing comparative compound A after development of 3 minutes while no pepper fog occurred in the samples (Nos. 4–11) containing the compounds of this invention.

TABLE 6-continued

| Film No. | Compound | Dot quanlity |
|---|---|---|
| 3 | " | 3 |
| 4 | (II-1) | 5 |
| 5 | " | 5 |
| 6 | (II-6) | 5 |
| 7 | " | 5 |
| 8 | (II-10) | 4 |
| 9 | " | 5 |
| 10 | (II-11) | 4 |
| 11 | " | 5 |

TABLE 4

| | | | Developing time (20° C.) | | | | | | | | | | | |
|---|---|---|---|---|---|---|---|---|---|---|---|---|---|---|
| | | | 1 min | | | 2 min. | | | 3 min. | | | 5 min. | | |
| Film No. | Compound | Addition amount[a] | Sensitivity[b] | $\gamma^c$ | Fog | Sensitivity[b] | $\gamma^c$ | Fog | Sensitivity[b] | $\gamma^c$ | Fog | Sensitivity[b] | $\gamma^c$ | Fog |
| 1 | None | — | 8.1 | 4.0 | 0.00 | 9.1 | 4.0 | 0.00 | 10.0 | 4.1 | 0.00 | 10.2 | 4.0 | 0.02 |
| 2 | (A) | $2.0 \times 10^{-4}$ | 25.1 | 3.0 | " | 55.3 | 8.5 | " | 76.8 | >10 | 0.05 | 111.0 | >10 | 0.10 |
| 3 | " | $2.5 \times 10^{-3}$ | 30.2 | 3.5 | " | 75.9 | 10.0 | " | 89.1 | >10 | 0.07 | 138.0 | >10 | 0.15 |
| 4 | (II-1) | $2.0 \times 10^{-4}$ | 91.2 | >10 | " | 125.9 | >10 | " | 134.9 | >10 | 0.00 | 144.5 | >10 | 0.01 |
| 5 | " | $2.5 \times 10^{-3}$ | 110.0 | >10 | " | 135.0 | >10 | " | 145.0 | >10 | " | 151.8 | >10 | 0.02 |
| 6 | (II-6) | $2.0 \times 10^{-4}$ | 81.3 | >10 | " | 110.0 | >10 | " | 121.0 | >10 | " | 130.0 | >10 | 0.01 |
| 7 | " | $2.5 \times 10^{-3}$ | 96.2 | >10 | " | 115.0 | >10 | " | 123.8 | >10 | " | 132.0 | >10 | 0.02 |
| 8 | (II-10) | $2.0 \times 10^{-4}$ | 79.3 | 9.5 | " | 100.0 | >10 | " | 108.0 | >10 | " | 119.3 | >10 | 0.01 |
| 9 | " | $2.5 \times 10^{-3}$ | 82.0 | >10 | " | 108.0 | >10 | " | 115.0 | >10 | " | 120.8 | >10 | " |
| 10 | (II-11) | $2.0 \times 10^{-4}$ | 75.0 | 8.5 | " | 90.5 | >10 | " | 103.0 | >10 | " | 114.2 | >10 | " |
| 11 | " | $2.5 \times 10^{-3}$ | 80.0 | >10 | " | 92.6 | >10 | " | 105.6 | >10 | " | 118.0 | >10 | 0.02 |

EXAMPLE 5

A part of each sample obtained in Example 4 was warmed at 40° C. for 30 days and thereafter, subjected to exposure and development (20° C,, 30 min.) in the same manner as in Example 1 and sensitivity and degree of fog were compared with those of samples just after coating. The results are shown in Table 5.

TABLE 5

| | | Just after coating | | After warming at 40° C. for 30 days | |
|---|---|---|---|---|---|
| Film No. | Compound | Sensitivity | Fog | Sensitivity | Fog |
| 1 | None | 10.0 | 0.00 | 10.5 | 0.02 |
| 2 | (A) | 76.8 | 0.05 | 80.5 | 0.10 |
| 3 | " | 89.1 | 0.07 | 92.3 | 0.13 |
| 4 | (II-1) | 134.9 | 0.00 | 135.0 | 0.01 |
| 5 | " | 145.0 | " | 145.3 | " |
| 6 | (II-6) | 121.0 | " | 121.8 | 0.00 |
| 7 | " | 123.8 | " | 124.1 | 0.01 |
| 8 | (II-10) | 108.0 | " | 109.0 | " |
| 9 | " | 115.0 | " | 116.0 | " |
| 10 | (II-11) | 103.0 | " | 103.5 | 0.00 |
| 11 | " | 105.6 | " | 106.0 | 0.01 |

As is clear from Table 5, the compounds of this invention caused very little change in sensitivity and increase in fog with time during storage.

EXAMPLE 6

Another portion of each of the film samples obtained in Example 4 was subjected to a test on dot quality in the same manner as in Example 3 and evaluated as in Example 3. The results are shown in Table 6.

TABLE 6

| Film No. | Compound | Dot quanlity |
|---|---|---|
| 1 | None | 1 |
| 2 | (A) | 3 |

As is clear from Table 6, the compounds of this invention provided good dot quality.

EXAMPLE 7

A silver iodobromide emulsion was prepared in the same manner as in Example 1 except that no hydrazine compounds were added and the emulsion was subjected to chemical sensitization with sodium thiosulfate and spectral sensitization. This emulsion was coated on a polyester film at a coverage of 3.7 g/m$^2$ in terms of silver.

Thus produced film sample was subjected to wedge exposure and then developed at 20° C. for 1–5 minutes with the same developer as used in Example 1 except that the compounds of the general formula (III) as indicated in Table 7 and the following comparative compounds were added in an amount of 1 mmol/1, respectively. The results are shown in Table 7.

Comparative compound (B)

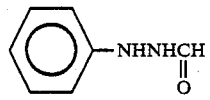

Comparative compound (C)

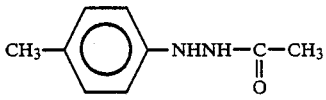

Comparative compound (D)

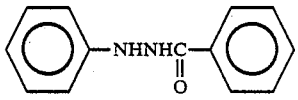

TABLE 7

| Film No. | Compound | Developing time (20° C.) 1 min. Sensitivity[b] | γ[c] | Fog | 3 min. Sensitivity[b] | γ[c] | Fog | 5 min. Sensitivity[b] | γ[c] | Fog |
|---|---|---|---|---|---|---|---|---|---|---|
| 1 | None | 9.3 | 4.5 | 0.01 | 10.0 | 4.5 | 0.01 | 10.7 | 4.7 | 0.01 |
| 2 | (B) | 10.7 | 5.0 | " | 20.4 | 8.1 | 0.03 | 28.8 | 10.0 | 0.04 |
| 3 | (C) | 9.3 | 4.2 | " | 10.2 | 4.3 | 0.01 | 10.5 | 4.4 | 0.01 |
| 4 | (D) | 9.3 | 4.2 | " | 11.0 | 4.3 | " | 11.7 | 4.3 | " |
| 5 | III-1 | 12.9 | 5.0 | " | 22.4 | 10< | " | 31.6 | 10< | " |
| 6 | III-2 | 25.1 | 4.8 | " | 45.7 | 10< | " | 50< | 10< | 0.03 |
| 7 | III-7 | 11.7 | 5.0 | " | 17.7 | 8.5 | " | 30.0 | 10< | 0.01 |
| 8 | III-8 | 11.0 | 4.8 | " | 17.0 | 9.2 | " | 32.6 | 10< | " |
| 9 | III-11 | 16.2 | 4.8 | " | 30.9 | 10< | " | 33.1 | 10< | " |
| 10 | III-21 | 10.5 | 5.0 | " | 20.5 | 9.0 | " | 30.2 | 10< | " |
| 11 | III-22 | 10.7 | 4.7 | " | 29.8 | 8.4 | " | 44.7 | 10< | " |
| 12 | III-25 | 10.8 | 5.8 | " | 20.5 | 8.4 | " | 23.1 | 10< | " |

As is clear from Table 7, the compounds of this invention provided high contrast photographic characteristic and caused no increase of fog even after development for a long time.

EXAMPLE 8

The silver iodobromide emulsion obtained in Example 1 was divided into 9 portions, to each of which was added each of the compounds III-12, III-18 and III-22 and the following comparative compound E in the amounts as indicated in Table 8. Then, each of the emulsions was coated on a polyester film at a coverage of 3.7 g/m$^2$ in terms of silver.

Thus obtained film samples were subjected to wedge exposure and then developed with the same developer as in Example 1 at 20° C. for 1–5 minutes.

The results are shown in Table 8.

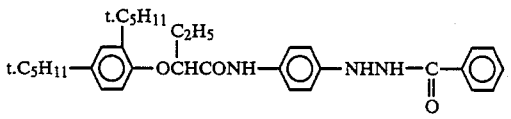

(E)

TABLE 8

| Film No. | Compound | Addition amount[a] | Developing time (20° C.) 1 min. Sensitivity[b] | γ[c] | Fog | 3 min. Sensitivity | γ | Fog | 5 min. Sensitivity | γ | Fog |
|---|---|---|---|---|---|---|---|---|---|---|---|
| 1 | None | | 8.1 | 4.0 | 0.00 | 10.0 | 4.1 | 0.00 | 10.2 | 4.0 | 0.02 |
| 2 | (E) | ① | 8.0 | 4.1 | " | 11.5 | 4.3 | 0.05 | 12.0 | 4.4 | 0.00 |
| 3 | " | ② | 8.3 | 4.3 | " | 12.0 | 4.5 | 0.07 | 13.4 | 4.5 | " |
| 4 | III-12 | ① | 51.5 | 9.0 | " | 62.7 | 10< | 0.00 | 65.1 | 10< | " |
| 5 | " | ② | 55.0 | 9.3 | " | 65.8 | " | 0.02 | 67.2 | " | 0.03 |
| 6 | III-18 | ① | 75.8 | 10< | " | 94.8 | " | 0.00 | 114.2 | " | 0.00 |
| 7 | " | ② | 84.5 | 10< | " | 100.4 | " | " | 121.0 | " | " |
| 8 | III-22 | ① | 45.8 | 8.9 | " | 60.2 | " | " | 71.2 | " | " |
| 9 | " | ② | 50.1 | 9.5 | " | 62.5 | " | 0.02 | 75.0 | " | 0.03 |

Addition amount:
①2.0 × 10$^{-4}$ mol/mol Ag
②2.5 × 10$^{-3}$ mol/mol Ag

As is clear from Table 8, the compounds of this invention nearly provided the high contrast photographic characteristic even with the development of one minute at 20° C. and caused no or little increase in fog even after development for a long time.

The unexposed portions of each sample after development were observed to find no pepper fog in the samples containing the compounds of this invention.

What is claimed is:

1. A method for producing images which comprises imagewise exposing a silver halide photographic light-sensitive material containing a surface latent image silver halide emulsion layer and then developing the exposed light-sensitive material in the presence of a compound which provides high contrast photographic characteristics represented by general formula [II]:

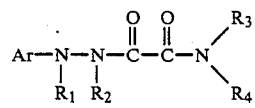

[II]

wherein Ar represents an aryl group, $R_1$ and $R_2$ each represent a hydrogen atom or a group represented by general formula (i):

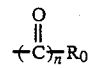

(i)

wherein $R_0$ represents an alkyl group, an alkenyl group, an aryl group, an alkoxy group or an aryloxy group and n is an integer of 1 or 2, $R_3$ represents a hydrogen atom, and $R_4$ is an unsaturated hetero ring group.

2. A method for producing images according to claim 1 wherein the compound represented by the general formula [II]is present in a silver halide emulsion layer or a hydrophilic colloid layer contiguous to the emulsion layer.

3. A method for producing images according to claim 2 wherein content of the compound is about $1\times10^{-6}$–$1\times10^{-2}$ mol for one mol of silver in the emulsion layer.

4. A method for producing images according to claim 1 wherein the compound of the general formula [II], is present in a developer.

5. A method for producing images accoding to claim 4 wherein amount of the compound is $10^{-4}$-$10^{-1}$ mol/1.

6. A silver halide photographic light-sensitive material which comprises a support and at least a silver halide emulsion layer containing a surface latent image silver halide emulsion and compound which provides high contrast photographic characteristics represented by general formula [III]:

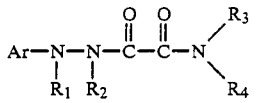

[II]

wherein Ar represents an aryl group, $R_1$ and $R_2$ each represent a hydrogen atom or a group represented by general formula (i):

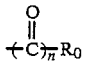

(i)

wherein $R_0$ represents an alkyl group, an alkenyl group, an aryl group, an alkoxy group or an aryloxy group and n is an integer of 1 or 2, $R_3$ represents a hydrogen atom, and $R_4$ is an unsaturated hetero ring group.

* * * * *